US010564592B2

(12) United States Patent
Suzuki et al.

(10) Patent No.: US 10,564,592 B2
(45) Date of Patent: Feb. 18, 2020

(54) IMAGE FORMING APPARATUS INCLUDING A REMOVABLE COMPONENT WHICH IS HELD BY HOLDER

(71) Applicant: RICOH COMPANY, LTD., Tokyo (JP)

(72) Inventors: Michiharu Suzuki, Kanagawa (JP); Jun Shiori, Kanagawa (JP); Hideo Yoshizawa, Kanagawa (JP); Toshio Koike, Tokyo (JP); Teppei Kikuchi, Kanagawa (JP); Kazuhiro Aso, Kanagawa (JP); Keinosuke Kondoh, Kanagawa (JP)

(73) Assignee: RICOH COMPANY, LTD, Tokyo (JP)

( * ) Notice: Subject to any disclaimer, the term of this patent is extended or adjusted under 35 U.S.C. 154(b) by 0 days.

(21) Appl. No.: 16/238,558

(22) Filed: Jan. 3, 2019

(65) Prior Publication Data

US 2019/0227479 A1 Jul. 25, 2019

(30) Foreign Application Priority Data

Jan. 23, 2018 (JP) ..... 2018-008970

(51) Int. Cl.

| | |
|---|---|
| ***G03G 15/00*** | (2006.01) |
| ***G03G 15/08*** | (2006.01) |
| ***G03G 15/20*** | (2006.01) |
| ***G03G 21/16*** | (2006.01) |

(52) U.S. Cl.
CPC ..... *G03G 21/1633* (2013.01); *G03G 21/1647* (2013.01)

(58) Field of Classification Search
CPC ..... G03G 15/0865; G03G 15/0867; G03G 15/1633; G03G 15/2032; G03G 15/2035; G03G 21/16; G03G 21/1623; G03G 21/1633; G03G 21/1647; G03G 21/185
USPC ..... 399/110, 111, 122, 258, 262
See application file for complete search history.

(56) References Cited

U.S. PATENT DOCUMENTS

| | | | | |
|---|---|---|---|---|
| 9,146,530 | B2 * | 9/2015 | Seto et al. | G03G 21/185 |
| 2014/0112687 | A1 | 4/2014 | Ohmura et al. | |
| 2014/0270838 | A1 | 9/2014 | Yoshizawa et al. | |
| 2015/0078788 | A1 | 3/2015 | Koike et al. | |
| 2015/0227086 | A1 | 8/2015 | Kondoh et al. | |

(Continued)

FOREIGN PATENT DOCUMENTS

| | | |
|---|---|---|
| JP | 2006-058350 | 3/2006 |
| JP | 2012-022141 | 2/2012 |
| JP | 2016-031469 | 3/2016 |

*Primary Examiner* — William J Royer
(74) *Attorney, Agent, or Firm* — Xsensus LLP

(57) ABSTRACT

An image forming apparatus includes an apparatus body, a removable component configured to be removably installed in an installation position in the apparatus body, a cover configured to open and close when the removable component is removed from or installed in the installation position, a replacement removable component configured to be installable in and removable from the installation position in which the removable component is installed, and a holder configured to hold the replacement removable component at a different position from the installation position when the removable component is installed in the installation position and the cover opens. The replacement removable component held by the holder is configured to inhibit the cover from closing.

9 Claims, 8 Drawing Sheets

(56) References Cited

U.S. PATENT DOCUMENTS

| | | | |
|---|---|---|---|
| 2015/0248107 | A1 | 9/2015 | Hamada et al. |
| 2015/0338824 | A1 | 11/2015 | Shimizu et al. |
| 2016/0026113 | A1 | 1/2016 | Takahashi et al. |
| 2016/0195846 | A1 | 7/2016 | Koshizuka et al. |
| 2016/0223946 | A1 | 8/2016 | Kikuchi et al. |
| 2016/0306300 | A1 | 10/2016 | Hamada et al. |
| 2016/0342134 | A1 | 11/2016 | Shiori et al. |
| 2018/0321615 | A1 | 11/2018 | Suzuki et al. |
| 2018/0335721 | A1 | 11/2018 | Koike et al. |

* cited by examiner

IMAGE FORMING APPARATUS INCLUDING A REMOVABLE COMPONENT WHICH IS HELD BY HOLDER

CROSS-REFERENCE TO RELATED APPLICATION

This patent application is based on and claims priority pursuant to 35 U.S.C. § 119(a) to Japanese Patent Application No. 2018-008970, filed on Jan. 23, 2018, in the Japan Patent Office, the entire disclosure of which is hereby incorporated by reference herein.

BACKGROUND

Technical Field

This disclosure generally relates to an image forming apparatus such as a copier, a printer, a facsimile machine, or a multifunction peripheral (MFP) having at least two of copying, printing, facsimile transmission, plotting, and scanning capabilities.

Description of the Related Art

There have been image forming apparatuses, such as copiers, printers, facsimile machines, or MFPs, that include a removable component, such as a process cartridge, a developing device, and a sub-hopper. The removable component is installable in and removable from an installation position in the image forming apparatus. The removable component is replaced with a replacement removable component in the installation position instead of the removable component for rearranging or simply replacing the removable component.

SUMMARY

According to embodiments of the present disclosure, an improved image forming apparatus includes an apparatus body, a removable component configured to be removably installed in an installation position in the apparatus body, a cover configured to open and close when the removable component is removed from or installed in the installation position, a replacement removable component configured to be installable in and removable from the installation position in which the removable component is installed, and a holder configured to hold the replacement removable component at a different position from the installation position when the removable component is installed in the installation position and the cover opens. The replacement removable component held by the holder is configured to inhibit the cover from closing.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
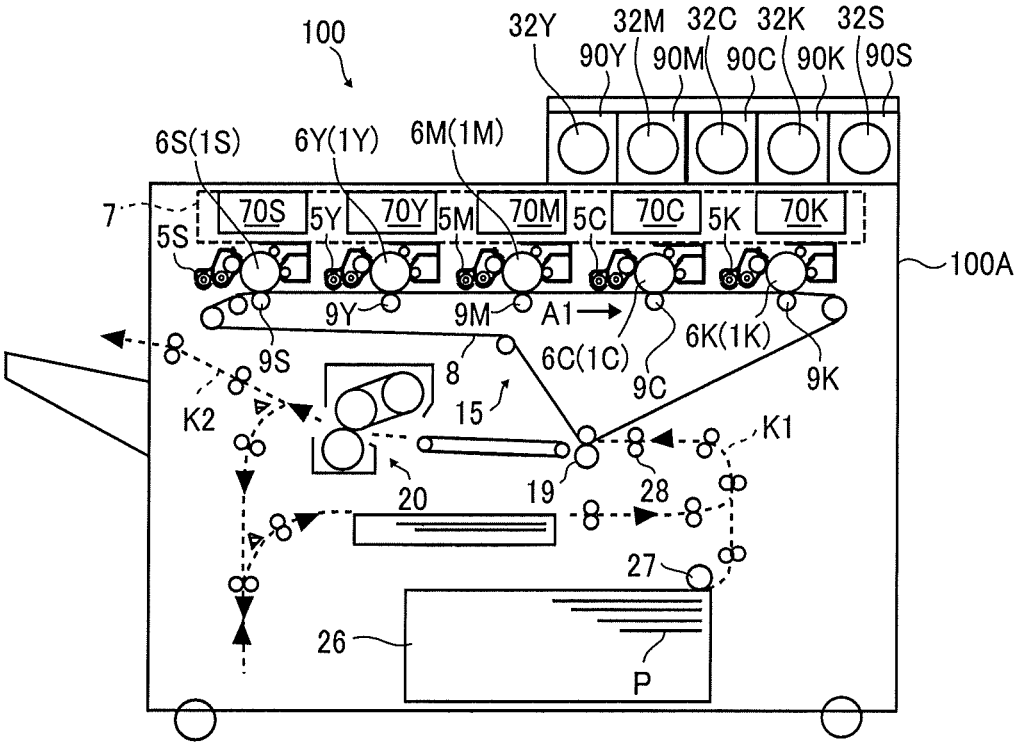
FIG. 1 is a schematic view illustrating a configuration of an image forming apparatus according to an embodiment of the present disclosure.

The accompanying drawings are intended to depict embodiments of the present disclosure and should not be interpreted to limit the scope thereof. The accompanying drawings are not to be considered as drawn to scale unless explicitly noted. In addition, identical or similar reference numerals designate identical or similar components throughout the several views.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that have the same function, operate in a similar manner, and achieve a similar result.

As used herein, the singular forms "a", "an", and "the" are intended to include the plural forms as well, unless the context clearly indicates otherwise.

It is to be noted that the suffixes Y, M, C, K, and S attached to each reference numeral indicate only that components indicated thereby are used for forming yellow, magenta, cyan, black, special color images, respectively, and hereinafter may be omitted when color discrimination is not necessary.

Embodiments of the present disclosure are described in detail with reference to drawings. It is to be understood that identical or similar reference numerals are assigned to identical or corresponding components throughout the drawings, and redundant descriptions are omitted or simplified below.

Figure 2:
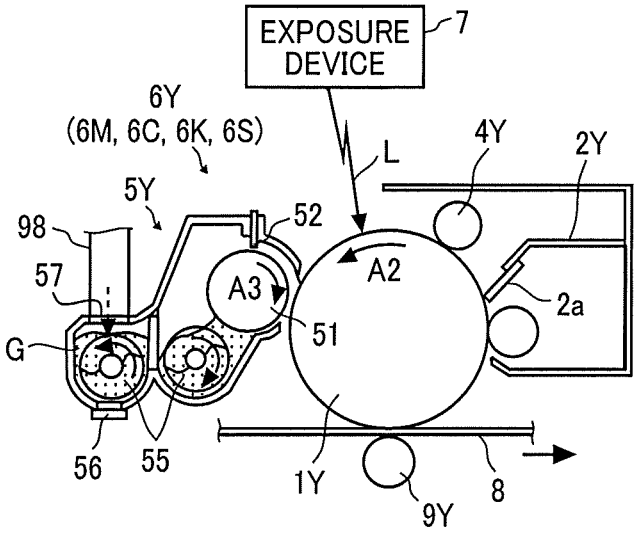
FIG. 2 is a cross-sectional view of a process cartridge and vicinity thereof in the image forming apparatus illustrated in FIG. 1.

Referring to FIGS. 1 and 2, a configuration and operation of an image forming apparatus 100 according to the present embodiment are described below.

FIG. 1 is a schematic view illustrating a configuration of the image forming apparatus 100, which in the present embodiment is a printer, for example. FIG. 2 is an enlarged view of a process cartridge 6Y and vicinity thereof in the image forming apparatus 100 illustrated in FIG. 1.

As illustrated in FIG. 1, the image forming apparatus 100 includes an intermediate transfer belt 8 as an intermediate transferor that moves in a predetermined direction of rotation of the intermediate transfer belt 8 indicated by arrow A1 in FIG. 1, in a center of the image forming apparatus 100. A plurality of photoconductor drums 1Y, 1M, 1C, 1K, and 1S as a plurality of image bearers is disposed facing the intermediate transfer belt 8 and arranged side by side along the direction of rotation of the intermediate transfer belt 8.

A plurality of developing devices 5Y, 5M, 5C, 5K, and 5S is removably installed in the image forming apparatus 100. The plurality of developing devices 5Y, 5M, 5C, 5K, and 5S develops latent images formed on the plurality of photoconductor drums 1Y, 1M, 1C, 1K, and 1S (the plurality of image bearers) with different colors, respectively.

As illustrated in FIG. 1, a plurality of toner containers 32Y, 32M, 32C, 32K, and 32S as a plurality of developer containers contains toners of different colors as developer therein and is removably installed in an upper portion of the image forming apparatus 100.

Figure 3:
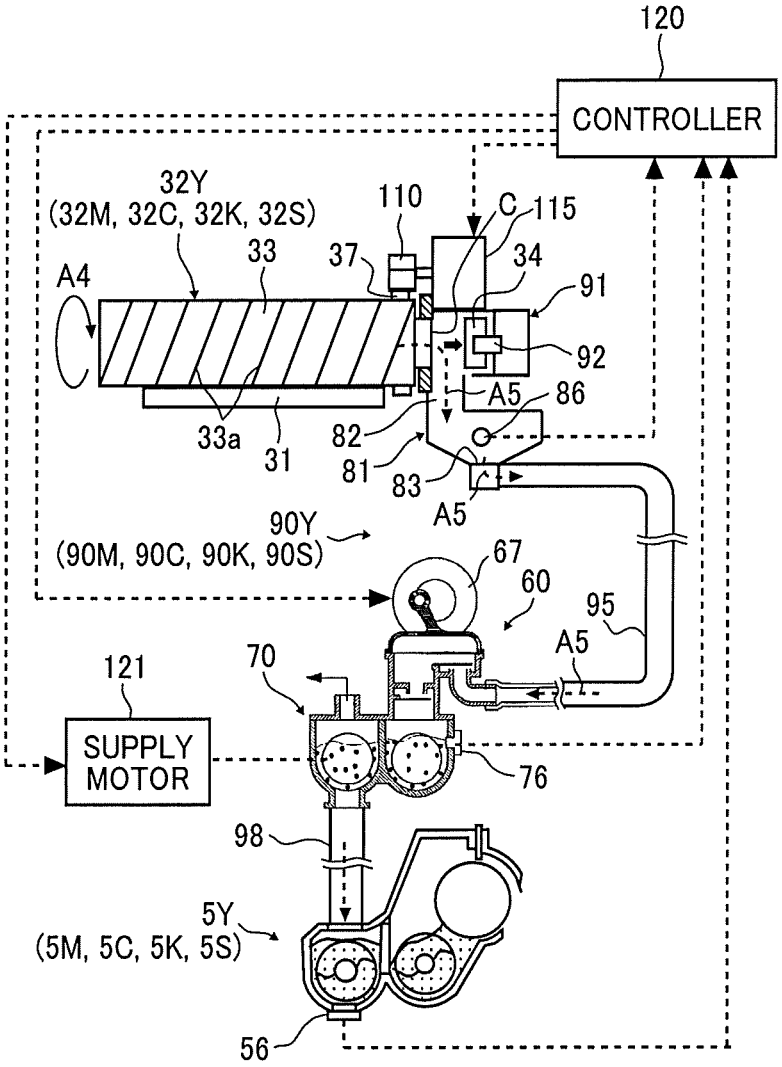
FIG. 3 is a schematic view illustrating a configuration of a developer supply device in the image forming apparatus illustrated in FIG. 1.

A plurality of developer supply devices 90Y, 90M, 90C, 90K, and 90S is installed in the image forming apparatus 100 to supply the toners contained in the plurality of toner containers 32Y, 32M, 32C, 32K, and 32S to the plurality of developing devices 5Y, 5M, 5C, 5K, and 5S, respectively. Referring to FIG. 3, the plurality of developer supply devices 90Y, 90M, 90C, 90K, and 90S includes a cap holder 91, a reservoir 81, a conveyance pump 60, a sub-hopper 70, a tube 95, and a conveyance pipe 98.

More specifically, the five toner containers 32Y, 32M, 32C, 32K, and 32S (the developer containers), which are substantially cylindrical in the present embodiment, are removably installed in the developer supply devices 90Y, 90M, 90C, 90K, and 90S (the toner supply device), respectively.

As illustrated in FIG. 1, the toner container 32S (and the developer supply device 90S) for special color is disposed on the rightmost side of the toner containers 32Y, 32M, 32C, 32K, and 32S. The toner container 32K (and the developer supply device 90K) for black is disposed on the left side of the toner container 32S. On the left side of the toner container 32K, the toner containers 32Y, 32M, and 32C (and the developer supply devices 90Y, 90M, and 90C) corresponding to three colors (yellow, magenta, and cyan) are disposed in order of cyan, magenta, and yellow from the right.

In particular, the toner container 32S for special color is often replaced with a toner container 32S for another type of special color depending on usage before all of the toner contained therein is consumed. Accordingly, the toner container 32S is replaced more frequently than the other toner containers 32Y, 32M, 32C, and 32K are.

Referring to FIG. 1, the developer supply device 90K for black supplies black toner (developer) contained in the toner container 32K (the developer container) for black to the developing device 5K for black.

In addition, the three developer supply devices 90Y, 90M, and 90C for yellow, magenta, and cyan supply color toners of yellow, magenta, and cyan (developers) contained in the toner containers 32Y, 32M, and 32C (the developer containers) for colors to the developing devices 5Y, 5M, and 5C for colors, respectively.

The developer supply device 90S for special color supplies special color toner (developer) contained in the toner container 32S (the developer container) for special color to the developing device 5S for special color.

Any toner can be used as the black toner; the color toner of each of yellow, magenta, and cyan; or the special color toner.

In particular, the special color toner is different from the black toner and the color toner, and any clear toner (transparent toner, colorless toner, achromatic toner, no-pigment toner, or the like), white toner, or the like can be used depending on usage.

Referring to FIG. 1, an exposure device 7 and sub-hoppers 70Y, 70M, 70C, 70K, and 70S (also collectively referred to as sub-hoppers 70 unless distinguished) are disposed in an upper section of the image forming apparatus 100, and process cartridges 6Y, 6M, 6C, 6K, and 6S, including the developing devices 5Y, 5M, 5C, 5K, and 5S, corresponding to yellow, magenta, cyan, black, and special color are disposed side by side under the exposure device 7, facing an intermediate transfer device 15 including the intermediate transfer belt 8.

As illustrated in FIG. 1, in a basic arrangement, the five process cartridges 6Y, 6M, 6C, 6K, and 6S, including the developing devices 5Y, 5M, 5C, 5K, and 5S, are disposed in the order of the process cartridge 6S (the developing device 5S) for special color, the process cartridge 6Y (the developing device 5Y) for yellow, the process cartridge 6M (the developing device 5M) for magenta, the process cartridge 6C (the developing device 5C) for cyan, and the process cartridge 6K (the developing device 5K) for black from upstream in the direction of rotation of the intermediate transfer belt 8 (hereinafter, referred to as a rotation direction).

The five sub-hoppers 70Y, 70M, 70C, 70K, and 70S are arranged in the same order as the process cartridges 6Y, 6M, 6C, 6K, and 6S (the developing devices 5Y, 5M, 5C, 5K, and 5S). The five sub-hoppers 70 are united with five conveyance pumps 60 for yellow, magenta, cyan, black, and special color, respectively.

However, the arrangement order (the arrangement) is appropriately variable depending on usage. With such a configuration, an optimum image can be formed depending on usage. The arrangement is changed with components of the same color, such as the developing device 5, the sub-hopper 70, the conveyance pump 60, and the like, so that toners of different colors are not mixed in the developing device 5 or the sub-hopper 70 (color mixing does not occur).

It can be seen that, in the present embodiment, the sub-hopper 70K, the conveyance pump 60K, and the process cartridge 6K (the developing device 5K) for black and the sub-hopper 70S, the conveyance pump 60S, and the process cartridge 6S (the developing device 5S) for special color can be swapped.

The present embodiment is featured in swap process of the sub-hopper 70K for black and the sub-hopper 70S for special color, which is described in detail later with reference to FIG. 6A-6D.

The special color toner is not limited to one type, and in many cases, different types of toner containers 32S for special colors are installed depending on usage as necessary. For example, the toner container 32S for clear toner may be replaced with the toner container 32S for white toner.

In such a case, depending on the type of special color toner, the process cartridge 6S (the developing device 5S) for special color is preferably moved from an extreme upstream installation position to an extreme downstream installation position in the rotation direction of the intermediate transfer belt 8. For example, the clear toner as the special color toner is often used for improving the glossiness of an image, and it is desirable that the clear toner be primarily transferred onto the intermediate transfer belt 8 first. Accordingly, as illustrated in FIGS. 1, the process cartridge 6S (the developing device 5S) for special color is disposed at the extreme upstream installation position in the rotation direction of the intermediate transfer belt 8. Meanwhile, the white toner as the special color toner is often used for forming an image on a colored sheet P that is not white, and it is desirable that the white toner be secondarily transferred in the lowermost layer on a sheet P. Accordingly, the process cartridge 6S (the developing device 5S) for special color is disposed at the extreme downstream installation position in the rotation direction of the intermediate transfer belt 8. With the rearrangement of the installation position of the process cartridge 6S (the developing device 5S) for special color, the installation position of the process cartridge 6K (the developing device 5K) for black is replaced with the installation position of the process cartridge 6S (the developing device 5S). With such a rearrangement of the installation position of the process cartridges 6S and 6K (the developing devices 5S and 5K), the sub-hopper 70S (and the conveyance pump 60S) for special color and the sub-hopper 70K (and the conveyance pump 60K) for black are swapped.

Users or service engineers manually perform the rearrangement operation according to procedures displayed on a control panel disposed on the exterior of the image forming apparatus 100.

Referring to FIG. 2, the process cartridge 6Y for yellow is a single-piece removable component removably installed in the image forming apparatus 100, includes the photoconductor drum 1Y as the image bearer, and further includes a charger 4Y, the developing device 5Y, and a cleaner 2Y disposed around the photoconductor drum 1Y. Image forming processes, namely, charging, exposure, development, transfer, and cleaning processes are performed on the photoconductor drum 1Y, and thus a yellow toner image is formed on the photoconductor drum 1Y.

Note that, the other process cartridges 6M, 6C, 6K, and 6S have a similar configuration to the process cartridge 6Y for yellow except the color of the toner used therein and form magenta, cyan, black, and special color toner images, respectively. Thus, only the process cartridge 6Y is described below and descriptions of other process cartridges 6M, 6C, 6K, and 6S are omitted.

Referring to FIG. 2, the photoconductor drum 1Y as the image bearer is rotated counterclockwise indicated by arrow A2 in FIG. 2 by a driving motor. The charger 4Y uniformly charges a surface of the photoconductor drum 1Y at a position opposite the charger 4Y (a charging process).

When the surface of the photoconductor drum 1Y reaches a position to receive a laser beam L emitted from the exposure device 7 (i.e., a writing device), the photoconductor drum 1Y is scanned with the laser beam L, and thus an electrostatic latent image for yellow is formed on the surface of the photoconductor drum 1Y (an exposure process).

Then, the surface of the photoconductor drum 1Y reaches a position facing a developing roller 51 of the developing device 5Y, where the electrostatic latent image is developed with toner into a yellow toner image (a development process).

When the surface of the photoconductor drum 1Y carrying the toner image reaches a position facing a primary transfer roller 9Y via the intermediate transfer belt 8, the toner image on the photoconductor drum 1Y is transferred onto the intermediate transfer belt 8 (a primary transfer process). After the primary transfer process, a certain amount of untransferred toner remains on the photoconductor drum 1Y.

When the surface of the photoconductor drum 1Y reaches a position facing the cleaner 2Y, a cleaning blade 2*a* collects the untransferred toner from the photoconductor drum 1Y into the cleaner 2Y (a cleaning process).

Subsequently, the surface of the photoconductor drum 1Y reaches a position facing a discharger, and the discharger eliminates a residual potential from the photoconductor drum 1Y.

Thus, a series of image forming processes performed on the photoconductor drum 1Y is completed.

The above-described image forming processes are performed in the process cartridges 6M, 6C, 6K, and 6S similarly to the process cartridge 6Y for yellow. That is, the exposure device 7 irradiates the photoconductor drums 1M, 1C, 1K, and 1S of the process cartridges 6M, 6C, 6K, and 6S with the laser beams L based on image data. Specifically, the exposure device 7 includes light sources to emit the laser beams L, multiple optical elements, and a polygon mirror that is rotated by a motor. The laser beams L are directed to the respective photoconductor drums 1Y, 1M, 1C, 1K, and 1S via the multiple optical elements while being deflected by the polygon mirror.

Then, the toner images formed on the respective photoconductor drums 1Y, 1M, 1C, 1K, and 1S through the development process are primarily transferred and deposited one on another onto the intermediate transfer belt 8. Thus, a desired multicolor toner image is formed on the intermediate transfer belt 8.

In FIG. 1, the intermediate transfer device 15 includes the intermediate transfer belt 8 as the intermediate transferor, the five primary transfer rollers 9Y, 9M, 9C, 9K, and 9S, a driving roller, a secondary transfer backup roller, multiple tension rollers, a cleaning backup roller, and a belt cleaner. The intermediate transfer belt 8 is supported by and entrained around multiple rollers to rotate in the direction indicated by arrow A1 illustrated in FIG. 1 (clockwise) as one (the driving roller) of the multiple rollers rotates.

The five primary transfer rollers 9Y, 9M, 9C, 9K, and 9S are disposed facing the photoconductor drums 1Y, 1M, 1C, 1K, and 1S via the intermediate transfer belt 8, respectively. Specifically, the five primary transfer rollers 9Y, 9M, 9C, 9K, and 9S are pressed against the corresponding photoconductor drums 1Y, 1M, 1C, 1K, and 1S via the intermediate transfer belt 8 to form primary transfer nips, respectively. A primary transfer power source applies respective primary transfer biases opposite to toner in polarity to the primary transfer rollers 9Y, 9M, 9C, 9K, and 9S.

While rotating in the direction indicated by the arrow A1 in FIG. 1, the intermediate transfer belt 8 sequentially passes past the primary transfer nips between the photoconductor drums 1Y, 1M, 1C, 1K, and 1S and the corresponding primary transfer rollers 9Y, 9M, 9C, 9K, and 9S. Then, the single-color toner images on the photoconductor drums 1Y, 1M, 1C, 1K, and 1S are primarily transferred and deposited one on another onto the intermediate transfer belt 8.

Subsequently, the intermediate transfer belt 8 carrying the multicolor toner image reaches a position facing a secondary transfer roller 19. A secondary transfer backup roller and the secondary transfer roller 19 press against each other via the intermediate transfer belt 8, thereby forming a secondary transfer nip. The multicolor toner image on the intermediate transfer belt 8 is transferred onto a sheet P (a recording medium) conveyed to the secondary transfer nip (a secondary transfer process). At that time, toner that is untransferred onto the sheet P remains on a surface of the intermediate transfer belt 8.

The surface of the intermediate transfer belt 8 reaches a position facing the belt cleaner. At this position, the belt cleaner collects the untransferred toner remaining on the intermediate transfer belt 8.

Thus, a series of image transfer processes performed on the intermediate transfer belt 8 is completed.

Referring back to FIG. 1, the sheet P is conveyed from a sheet feeder 26 (specifically, a sheet tray) disposed in a lower portion of an apparatus body 100A of the image forming apparatus 100 to the secondary transfer nip through a sheet feeding path K1, along which a sheet feeding roller 27 and a registration roller pair 28 are disposed.

Specifically, the sheet feeder 26 contains a stack of multiple sheets P piled one on another. The sheet feeding roller 27 rotates counterclockwise in FIG. 1 to feed the sheet P on the top of the stack in the sheet feeder 26 toward a nip of the registration roller pair 28.

The registration roller pair 28 (a timing roller pair) temporarily stops rotating, stopping the sheet P with a leading edge of the sheet P nipped in the registration roller pair 28. The registration roller pair 28 resumes rotation to convey the sheet P to the secondary transfer nip, timed to coincide with the arrival of the multicolor toner image on the intermediate transfer belt 8. Accordingly, the desired multicolor toner image is transferred onto the sheet P.

Subsequently, the sheet P, onto which the multicolor toner image is transferred at the secondary transfer nip, is conveyed to a fixing device 20. In the fixing device 20, a fixing belt and a pressing roller apply heat and pressure to the sheet P to fix the multicolor toner image on the sheet P (a fixing process).

The sheet P is conveyed through an ejection path K2 and ejected by an ejection roller pair to the outside of the image forming apparatus 100. The sheets P are sequentially stacked as output images on a stack tray.

Thus, a series of image forming processes performed by the image forming apparatus 100 is completed.

Next, a configuration and operation of the developing device 5Y of the process cartridge 6Y are described in further detail below with reference to FIG. 2.

A casing of the developing device 5Y to contain developer G is divided, at least partially, into two developer containing compartments by a wall. The developing device 5Y includes the developing roller 51 as a developer bearer disposed facing the photoconductor drum 1Y, a doctor blade 52 disposed facing the developing roller 51, two conveying screws 55 respectively disposed in the developer containing compartments, a density sensor 56 to detect concentration (percentage) of toner in the developer G or toner density, and an opening 57 for supplying toner (developer) to the developer containing compartment. The developing roller 51 includes stationary magnets, a sleeve that rotates around the magnets, and the like. The developer containing compartments contain two-component developer G including carrier (carrier particles) and toner (toner particles).

With such a configuration, the developing device 5Y operates as follows.

The sleeve of the developing roller 51 rotates in a direction indicated by arrow A3 illustrated in FIG. 2. The developer G is transported on the developing roller 51 by a magnetic field generated by the magnets. As the sleeve rotates, the developer G moves along the circumference of the developing roller 51.

The percentage (concentration) of toner in the developer G (ratio of toner to carrier) in the developing device 5Y is adjusted within a predetermined range. Specifically, according to the consumption of toner in the developing device 5Y, the developer supply device 90Y (illustrated in FIG. 3) supplies toner (i.e., powder) from the toner container 32Y (the developer container) to the developing device 5Y (the developer containing compartment in particular). A configuration and operation of the toner container 32Y and the developer supply device 90Y are described in further detail later.

While being stirred with the developer G and circulated by the two conveying screws 55 in the developing device 5Y (the developer containing compartments), the supplied toner is circulated between the two developer containing compartments, which is separated by the wall, in a longitudinal direction of the developing device 5Y. The longitudinal direction of the developing device 5Y is perpendicular to the surface of the paper on which FIG. 2 is drawn. The toner in two-component developer G is charged by friction with carrier and electrostatically attracted to the carrier. The toner is carried on the developing roller 51 together with the carrier by magnetic force generated on the developing roller 51.

The developer G carried on the developing roller 51 is transported in the clockwise direction indicated by arrow A3 in FIG. 2 to the doctor blade 52. The doctor blade 52 adjusts the amount of developer G on the developing roller 51, after which the developer G is transported to a developing range facing the photoconductor drum 1Y. The toner in the developer G is attracted to the electrostatic latent image formed on the photoconductor drum 1Y due to the effect of an electric field generated in the developing range. As the sleeve rotates, the developer G remaining on the developing roller 51 reaches an upper part of the developer containing compartment, drops from the developing roller 51, and returns to the developer containing compartment.

The above-described electric field generated in the developing range is formed by potential difference between the exposure potential (the latent image potential) formed on the photoconductor drum 1Y by emission of the laser beam L and a development bias applied to the developing roller 51 by a development power supply.

Next, a configuration and operation of the developer supply device 90Y for yellow is described with reference to FIG. 3.

In the present embodiment, the four other developer supply devices (the developer supply device 90M for magenta, the developer supply device 90C for cyan, the developer supply device 90K for black, and the developer supply device 90S for special color) have substantially the same configuration as the developer supply device 90Y for yellow, except that the color (type) of the toner to be used is different. Therefore, descriptions of the developer supply devices 90M, 90C, 90K, and 90S are appropriately omitted, and only the developer supply device 90Y for yellow is described.

In FIG. 3 (and FIG. 4), suffixes Y, M, C, K, and S indicating respective colors to be attached to the reference numerals of the reservoir 81, the sub-hopper 70, and the conveyance pump 60 are omitted.

The developer supply device 90Y rotates the toner container 32Y as the developer container installed in a toner container mount 31 in a predetermined direction (direction indicated by arrow A4 in FIG. 3), discharges toner contained in the toner container 32Y to the outside of the toner container 32Y, and guides the toner to the developing device 5Y, thereby forming a toner supply route (a toner transport route).

In FIG. 3, the arrangement direction of the toner container 32Y, the developer supply device 90Y, and the developing device 5Y are changed for ease of understanding. In the present embodiment, the long axis of the toner container 32Y and a part of the developer supply device 90Y are perpendicular to the surface of the paper on which FIG. 3 is drawn (see FIG. 1). In addition, the orientation and arrangement of the tube 95 (a conveyance path) are also illustrated in a simplified manner.

The yellow toner contained in the toner container 32Y installed in the toner container mount 31 of the image forming apparatus 100 is supplied to the developing device 5Y by the developer supply device 90Y according to an amount of toner consumed in the developing device 5Y.

Specifically, when the toner container 32Y is set in the toner container mount 31 of the apparatus body 100A, a bottle gear 37 of the toner container 32Y meshes with a driving gear 110 of the apparatus body 100A, and the cap chuck 92 of a cap holder 91 removes a cap 34, which is for closing a toner outlet C, from the toner container 32Y. Accordingly, the toner outlet C of the toner container 32Y is opened, and the yellow toner is discharged from the toner container 32Y through the toner outlet C.

In the developer supply device 90Y, the reservoir 81 is disposed below the toner outlet C via a downward path 82. A suction port 83 is disposed in the bottom portion of the reservoir 81 and coupled to one end of the tube 95 (the conveyance path) via a nozzle. The tube 95 as the conveyance path is formed of a flexible material with low affinity for toner, and the other end of the tube 95 is coupled to the conveyance pump 60 (a diaphragm pump). The conveyance pump 60 is coupled to the developing device 5Y via the sub-hopper 70 and the conveyance pipe 98.

With such a configuration of the developer supply device 90Y, as the driving gear 110 is driven by a drive motor 115, a container body 33 of the toner container 32Y is rotated in a predetermined direction, thereby discharging toner from the toner outlet C of the toner container 32Y. Accordingly, toner discharged from the toner outlet C of the toner container 32Y falls through the downward path 82 and is stored in the reservoir 81. As the conveyance pump 60 operates, the toner stored in the reservoir 81 is sucked from the suction port 83 and transported to the conveyance pump 60 and to the sub-hopper 70 via the tube 95. The toner transported to the sub-hopper 70 is supplied into the developing device 5Y via the conveyance pipe 98 extending in the vertical direction. That is, the toner in the toner container 32Y is transported in the direction indicated by dashed arrows A5 in FIG. 3. In the present embodiment, unlike the tube 95, the conveyance pipe 98 that couples between the sub-hopper 70 and the developing device 5Y is formed of a hard resin material or a metal material which is hardly deformed.

Next, the conveyance pump 60 and the sub-hopper 70 of the developer supply device 90Y are described in detail with reference to FIG. 4.

In the present embodiment, the conveyance pump 60 is provided with the sub-hopper 70 as a single-piece unit.

Figure 4:
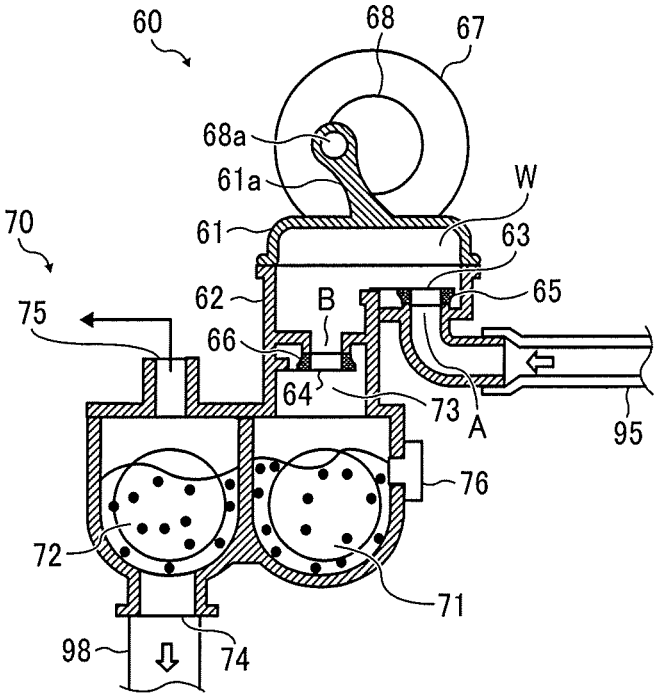
FIG. 4 is a cross-sectional view of a conveyance pump and a sub-hopper of the developer supply device in FIG. 3.

Referring to FIG. 4, the conveyance pump 60 in the present embodiment is the diaphragm pump (a positive displacement pump) and includes a diaphragm 61 (a rubber member), a case 62, a motor 67, a rotary plate 68, an inlet check valve 63 and an outlet check valve 64, seals 65 and 66 (elastic members), and the like. The conveyance pump 60 with such a configuration is relatively small and low in cost.

The case 62 and the diaphragm 61 together form a pump body of the conveyance pump 60.

The case 62 is made of a resin material or a metal material having rigidity and functions as a main part (housing) of the pump body of the conveyance pump 60. An inlet A for bringing the developer G together with air into the interior and an outlet B for discharging the developer G together with air from the interior are disposed in the case 62 (the pump body).

The diaphragm 61 is formed of a rubber material having elasticity and a low affinity for toner. The interior of the bowl-like portion functions as a variable volume portion W, and an arm 61*a* stands on the periphery thereof. An eccentric shaft 68*a* of the rotary plate 68 engages a hole of the arm 61*a*. The diaphragm 61 is joined with the case 62 without a gap, and the variable volume portion W of the diaphragm 61 and the inside of the case 62 are formed as one closed space inside the pump body of the conveyance pump 60 (i.e., the pump body). The diaphragm 61 expands and contracts by the rotary plate 68 (the eccentric shaft 68*a*) to be described later, thereby increasing and decreasing the internal volume. Therefore, the pump body of the conveyance pump 60 (i.e., the diaphragm 61 and the case 62) alternately generate positive pressure and negative pressure.

The rotary plate 68 is disposed on the motor shaft of the motor 67, and the eccentric shaft 68*a* is provided on the surface of the rotary plate 68 so as to stand upright at a position offset from the motor shaft (rotational center). The eccentric shaft 68*a* of the rotary plate 68 is inserted (fitted) into the hole formed in a tip of the arm 61*a* of the diaphragm 61.

With such a configuration, as the motor 67 is driven by a controller 120, the rotary plate 68 (the eccentric shaft 68*a*) rotates. Accordingly, the diaphragm 61 expands and contracts so as to increase and decrease the volume of the variable volume portion W periodically. With such expansion and contraction of the diaphragm 61, the positive pressure and the negative pressure are alternately generated inside the pump body composed of the diaphragm 61 and the case 62.

The inlet check valve 63 is disposed at the inlet A of the pump body (the case 62). The inlet check valve 63 opens the inlet A when the negative pressure is generated inside the pump body (the diaphragm 61 and the case 62) and closes the inlet A when the positive pressure is generated inside the pump body (the diaphragm 61 and the case 62). The inlet check valve 63 is provided to face the inlet A from the inside of the pump body (the diaphragm 61 and the case 62). The reservoir 81 is coupled to the inlet A of the conveyance pump 60 via the tube 95.

The outlet check valve 64 is disposed at the outlet B of the pump body (the case 62). The outlet check valve 64 closes the outlet B when the negative pressure is generated inside the pump body (the diaphragm 61 and the case 62) and opens the outlet B when the positive pressure is generated inside the pump body (the diaphragm 61 and the case 62). The outlet check valve 64 is provided to face the outlet B from the outside of the pump body (the diaphragm 61 and the case 62). The sub-hopper 70 is coupled to the outlet B of the conveyance pump 60.

With such a configuration and operation, as described above with reference to FIG. 3, as the conveyance pump 60 operates, the toner stored in the reservoir 81 is sucked from the suction port 83 and transported into the sub-hopper 70 through the tube 95. Specifically, when a hopper sensor 76 of the sub-hopper 70 detects a shortage of toner in the sub-hopper 70, the conveyance pump 60 (the motor 67) is driven to supply toner from the reservoir 81 to the sub-hopper 70.

When the hopper sensor 76 detects that the amount of toner in the sub-hopper 70 has not reached a predetermined amount and an insufficient state is detected, the conveyance pump 60 (the motor 67) is intermittently driven in short cycles. As a result, the amount of toner transported by a first conveyance screw 71 and a second conveyance screw 72 in the sub-hopper 70 can catch up with the amount of toner supplied from the conveyance pump 60, thereby preventing toner from stagnating in a part of the sub-hopper 70.

Referring to FIG. 4, the sub-hopper 70 includes the first conveyance screw 71, the second conveyance screw 72, the hopper sensor 76, a supply motor 121 (see FIG. 3), and the like. A supply port 73 communicating with the outlet B of the conveyance pump 60 is disposed above an upstream side of a first conveying path of the sub-hopper 70 in the direction of conveyance of toner. The first conveyance screw 71 is disposed in the first conveying path. A discharge port 74 is disposed under a downstream side of a second conveying path of the sub-hopper 70 in the direction of conveyance of toner and communicates with the developing device 5Y via the conveyance pipe 98. The second conveyance screw 72 is disposed in the second conveying path. Further, an exhaust port 75 for discharging air fed together with the toner from the conveyance pump 60 is disposed above the second conveying path of the sub-hopper 70.

As described above, the hopper sensor 76 detects the insufficient state in which the amount of toner (developer) contained in the sub-hopper 70 is below the predetermined amount.

In the sub-hopper 70, a downstream side of the first conveying path and an upstream side of the second conveying path in the direction of conveyance of toner communicate with each other (i.e. a communicating portion) on one end side in the longitudinal direction of the sub-hopper 70 perpendicular to the surface of the paper on which FIGS. 3 and 4 are drawn. The first conveying path and the second conveying path are separated from each other by the wall except the communicating portion.

The toner supplied into the sub-hopper 70 is conveyed through the first conveying path and the second conveying path in the sub-hopper 70 by the first conveyance screw 71 and the second conveyance screw 72 rotated by the supply motor 121 and is supplied from the sub-hopper 70 to the developing device 5Y via the conveyance pipe 98. Specifically, when the density sensor 56 of the developing device 5Y detects a shortage of the toner concentration in the developer containing compartment (a circulation path in which the conveying screw 55 circulates the toner), the controller 120 rotates the first conveyance screw 71 and the second conveyance screw 72 of the sub-hopper 70, thereby supplying the toner from the sub-hopper 70 to the developing device 5Y.

As described above, in the present embodiment, the conveyance path extending from the reservoir 81 to the conveyance pump 60 is formed with the flexible tube 95. Therefore, even when various components are installed in the space between the reservoir 81 and the conveyance pump 60, the tube 95 can be installed avoiding those components to secure the conveyance path. Therefore, the toner container mount 31 of the toner container 32Y can be freely laid out at a position away from the developing device 5Y.

Next, referring to FIG. 3, configurations of the toner container 32Y and the developer supply device 90Y are described below.

As described above, the toner container 32Y includes the container body 33 and the cap 34 detachably attached to the toner outlet C of the container body 33.

The bottle gear 37 that rotates together with the container body 33 and the toner outlet C are disposed on a head portion of the container body 33. The bottle gear 37 meshes with the driving gear 110 of the apparatus body 100A, and the driving gear 110 rotates the container body 33 with the bottle gear 37 in a predetermined direction. The toner outlet C is for discharging toner (powder) from the container body 33 to the downward path 82.

The container body 33 includes a helical protrusion 33*a* protruding inward from an outer circumferential face to an inner circumferential face of the container body 33. The helical protrusion 33*a* is for discharging toner from the container body 33 through the toner outlet C of the toner container 32Y by rotation of the container body 33.

The container body 33 can be produced together with the bottle gear 37 as a single unit by blow molding.

Referring to FIG. 3, the cap holder 91 of the developer supply device 90Y covers the head portion of the toner container 32Y installed in the toner container mount 31 (the developer supply device 90Y).

The cap holder 91 includes the cap chuck 92 for opening and closing the cap 34 in conjunction with the installation and removal operation of the toner container 32Y and an opening-closing driver for driving the cap chuck 92. The cap holder 91 is a part of the reservoir 81 as well as the downward path 82. As the toner container 32Y mounted on the toner container mount 31 is slid toward the cap holder 91 and the cap 34 reaches a position of the cap chuck 92, the opening-closing driver operates so that the cap 34 is separated from the toner outlet C in a state in which the cap chuck 92 holds the cap 34 in conjunction with an operation of the toner container 32Y that is slid further and pushed in. Thus, the toner outlet C of the toner container 32Y is opened, and toner can be discharged from the toner outlet C. Further, in conjunction with the installation operation of the toner container 32Y, the locking mechanism operates to lock the head portion of the toner container 32Y so as not to be removed from the toner container mount 31. At that time, the toner container 32Y is secured to the developer supply device 90Y (the toner container mount 31) so that the toner outlet C side (head) of the toner container 32Y is rotatable, and the container body 33 is rotatably supported on the toner container mount 31.

In removal of the toner container 32Y from the toner container mount 31, the above-described processes are performed in reverse.

Toner discharged from the toner container 32Y drops through the downward path 82 to the bowl-shaped reservoir 81 of the developer supply device 90Y and stored therein. The reservoir 81 includes a toner sensor 86 and a stirrer. The conveyance pump 60 coupled to the suction port 83 of the reservoir 81 via the tube 95 sucks the toner in the reservoir 81 and conveys the toner through the tube 95.

As described above, in the present embodiment, the toner discharged from the toner container 32Y is not directly sucked by the conveyance pump 60 but is stored in the reservoir 81 to some extent. Then, the conveyance pump 60 sucks the necessary amount of toner stored in the reservoir 81. Accordingly, such a configuration can minimize shortage of the toner sucked by the conveyance pump 60.

The toner sensor 86 is disposed near the suction port 83 and indirectly detects a state in which toner contained in the toner container 32Y is depleted (toner depletion), or a state close thereto (toner near depletion). Toner is discharged from the toner container 32Y based on the detection result of the toner sensor 86.

For example, a piezoelectric sensor or a light transmission sensor can be used as the toner sensor 86. In the present embodiment, a piezoelectric sensor is used as the toner sensor 86. The height of the detection surface of the toner sensor 86 is set so that the amount of toner (deposition height) deposited above the suction port 83 is a target value.

Based on the detection result of the toner sensor 86, the controller 120 determines a drive timing and a drive duration of the drive motor 115 to rotationally drive the toner container 32Y (the container body 33). Specifically, when the controller 120 determines that there is no toner at the detection position based on the detection result of the toner sensor 86, the drive motor 115 is driven for a predetermined time. On the other hand, when the controller 120 determines that the toner is present at the detection position based on the detection result of the toner sensor 86, the drive motor 115 is stopped.

Next, referring to FIGS. 5 to 7, the configuration and operation of the image forming apparatus 100 according to the present embodiment are described below.

As described above, in the image forming apparatus 100 according to the present embodiment, the sub-hopper 70K for black and the sub-hopper 70S for special color can be swapped. In other words, in the five sub-hoppers 70Y, 70M, 70C, 70K, and 70S illustrated in FIGS. 1 and 6A, the sub-hopper 70K for black disposed in a rightmost installation position as a basic position and the sub-hopper 70S for special color disposed in a leftmost installation position as a basic position are swapped. As a result, the sub-hopper 70K for black can be disposed in the leftmost installation position, and the sub-hopper 70S for special color can be disposed in the rightmost installation position as illustrated in FIG. 6D.

In the present embodiment, since each of the conveyance pumps 60 is united with the corresponding one of the five sub-hoppers 70, the conveyance pumps 60 are omitted in FIGS. 6A to 6D (and FIGS. 7 to 10D).

Figure 5:
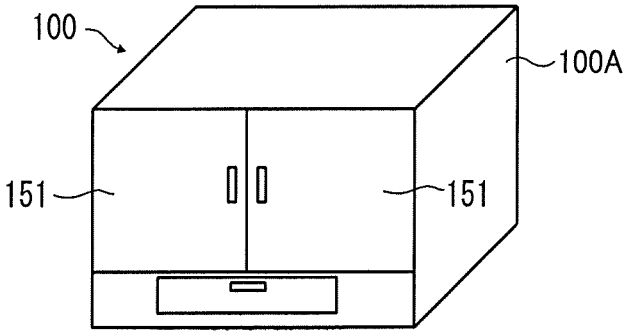
FIG. 5 is a schematic perspective view illustrating an exterior of the image forming apparatus according to an embodiment of the present disclosure.
Figure 6A:
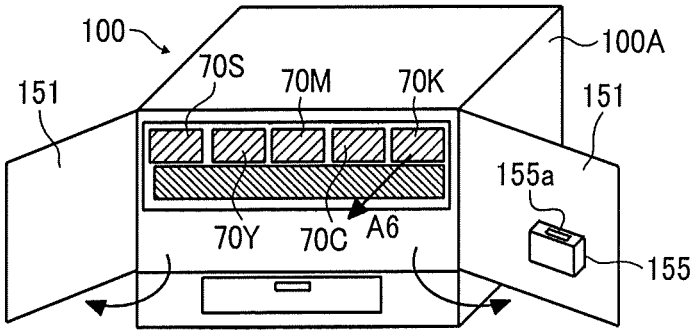
FIGS. 6A to 6D are schematic views illustrating processes of swapping the sub-hoppers according to an embodiment of the present disclosure.
Figure 6B:
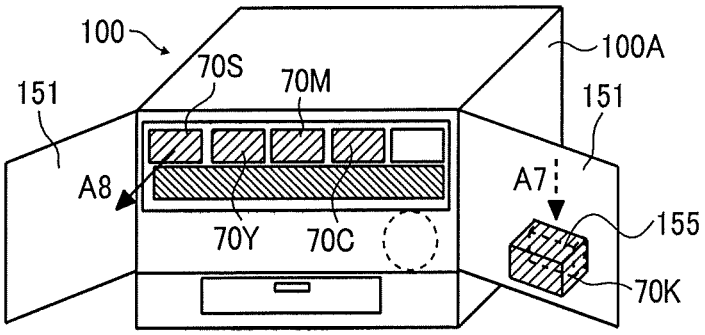
Figure 6C:
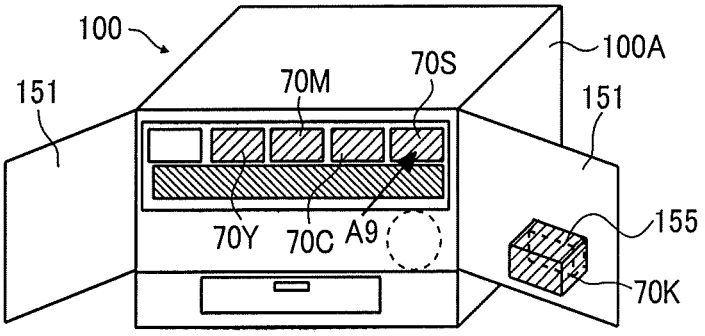
Figure 6D:
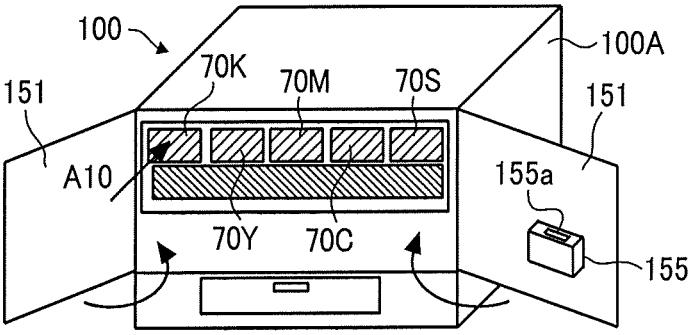

As illustrated in FIGS. 5 to 6D, the image forming apparatus 100 according to the present embodiment includes a cover 151 configured to open and close when the sub-hopper 70K for black and the sub-hopper 70S for special color are swapped.

The covers 151 are double doors hinged on hinges disposed left and right sides of the image forming apparatus 100 and opens around the hinges as the rotation centers to right and left, respectively. Further, the covers 151 function as a part of an exterior of the image forming apparatus 100.

When normal image formation is performed, the covers 151 close as illustrated in FIG. 5 so as not to reveal the interior of the apparatus body 100A. In addition to when the sub-hopper 70K for black and the sub-hopper 70S for special color are swapped, at the time of replacement of the process cartridge 6Y, 6M, 6C, 6K, or 6S, during maintenance of the fixing device 20, or when a jammed sheet P is removed, the covers 151 open around the hinges as the rotation centers from the state in FIG. 5 to the state illustrated in FIGS. 6A to 6D so as to reveal the interior of the apparatus body 100A.

Figure 7:
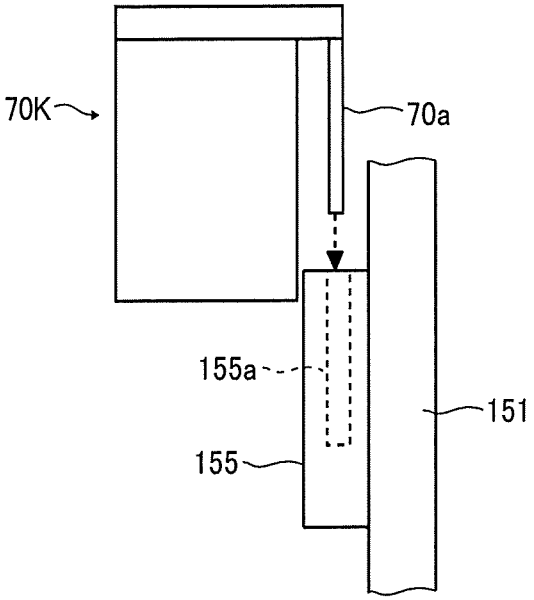
FIG. 7 is a side view illustrating the sub-hopper to engage with a holder attached to a cover according to an embodiment of the present disclosure.

Referring to FIGS. 6A to 7, the cover 151 includes a holder 155 configured to temporarily place the sub-hopper 70K for black when the sub-hopper 70K for black and the sub-hopper 70S for special color are swapped.

Specifically, as illustrated in FIG. 7, the sub-hopper 70K for black is a replacement removable component including a hook 70*a* (L-shaped plate). The holder 155 has an engagement portion 155*a*, with which the hook 70*a* engages. The engagement portion 155*a* is a substantially rectangular parallelepiped hole. An operator moves the sub-hopper 70K for black downward so that a tip of the hook 70*a* engages with the engagement portion 155*a*, and the holder 155 holds the sub-hopper 70K for black.

That is, the sub-hopper 70S for special color is a removable component that is installable in and removable from the apparatus body 100A as viewed based on the sub-hopper 70S for special color. Meanwhile, the sub-hopper 70K for black is the replacement removable component that is installable in and removable from a normal installation position (in the present embodiment, the leftmost installation position) of the sub-hopper 70S for special color as the removable component. In the image forming apparatus 100 according to the present embodiment, as illustrated in FIG. 6A, the sub-hopper 70K for black as the replacement removable component is removably installed in a position (in the present embodiment, the rightmost installation position) different from the normal installation position of the sub-hopper 70S for special color (the removable component) and the position of the holder 155 in normal time. In the image forming apparatus 100, the sub-hopper 70S for special color (the removable component) and the sub-hopper 70K for black (the replacement removable component) containing different color toners (developers) each other can be swapped.

The covers 151 open and close when the sub-hopper 70S for special color (the removable component) is installed in or removed from the apparatus body 100A. In particular, the covers 151 open and close when the sub-hopper 70S for special color (the removable component) and the sub-hopper 70K for black (the replacement removable component) are swapped.

The holder 155 is configured to hold the sub-hopper 70K for black at a position other than the installation position of the sub-hopper 70S for special color in a state that the covers 151 open and the sub-hopper 70S for special color is installed in the apparatus body 100A as illustrated in FIG. 6A. In the present embodiment, the holder 155 is disposed inside the cover 151 so as not to reveal the holder 155 when the covers 151 close as illustrated in FIG. 5.

As illustrated in FIGS. 6B and 6C, in the image forming apparatus 100 according to the present embodiment, the sub-hopper 70K for black as the replacement removable component held by the holder 155 inhibits the cover 151 from closing.

Specifically, when the cover 151 is about to close in a state in which the holder 155 holds the sub-hopper 70K for black, the sub-hopper 70K for black held by the holder 155 interferes with (contacts) a portion of the apparatus body 100A enclosed by dashed circles in FIGS. 6B and 6C, thereby inhibiting the cover 151 from closing.

More specifically, the holder 155 protrudes from the inner surface of the cover 151, and when the cover 151 closes, a recess (space) accommodates the holder 155 inside the apparatus body 100A so as to enable the cover 151 to open and close. On the other hand, the sub-hopper 70K for black held by the holder 155 further protrudes inward from the cover 151. Accordingly, the recess (the space) does not accommodate the sub-hopper 70K for black in the apparatus body 100A, thereby inhibiting the cover 151 from closing.

As described above, for rearrangement in which the sub-hopper 70S for special color (the removable component) and the sub-hopper 70K for black (the replacement removable component) are swapped, the holder 155 is provided to temporarily place the sub-hopper 70K for black. Therefore, when the sub-hopper 70S for special color is replaced with the sub-hopper 70K for black at the installation position of the sub-hopper 70S for special color instead of the sub-hopper 70S for special color, it does not take time and effort for the operator to secure space near the image forming apparatus 100. Further, since the sub-hopper 70K for black temporarily placed on the holder 155 inhibits the cover 151 from closing, the operator does not forget to install the sub-hopper 70K for black after removing the sub-hopper 70S for special color from the apparatus body 100A. As a result, an efficiency to swap the sub-hopper 70S for special color and the sub-hopper 70K for black is improved.

In the image forming apparatus 100 according to the present embodiment, when the holder 155 holds the sub-hopper 70K for black as the replacement removable component, the sub-hopper 70S for special color as the removable component can be removed from or installed in the apparatus body 100A.

Specifically, when the sub-hopper 70S for special color is removed from or installed in the apparatus body 100A in a state in which the holder 155 holds the sub-hopper 70K for black, the sub-hopper 70S for special color does not interfere with (contact) the sub-hopper 70K for black held by the holder 155 to remove and install the sub-hopper 70S for special color as illustrated in FIGS. 6B and 6C.

More specifically, the holder 155 is far enough from the installation positions of the five sub-hoppers 70Y, 70M, 70C, 70K, and 70S. In the present embodiment, the holder 155 is disposed below the sub-hoppers 70Y, 70M, 70C, 70K, and 70S. Therefore, the sub-hopper 70K held by the holder 155 does not overlap trajectories of the removal and installation of the sub-hopper 70S at the basic installation positions for the sub-hopper 70S for special color (the leftmost installation position) and for the sub-hopper 70K for black (the rightmost installation position).

As a result, the efficiency to swap the sub-hopper 70S for special color and the sub-hopper 70K for black is further improved.

In summary, referring to FIGS. 6A to 6D, descriptions are provided of processes of swapping the sub-hopper 70S for special color and the sub-hopper 70K for black from the basic arrangement by the operator.

As illustrated in FIG. 6A, the covers 151 open from the closed state in FIG. 5, and the five sub-hoppers 70Y, 70M, 70C, 70K, and 70S and the holder 155 are revealed. The operator removes the sub-hopper 70K for black from the apparatus body 100A in a direction indicated by arrow A6 in FIG. 6A and moves the removed sub-hopper 70K for black in a direction indicated by dashed arrow A7 to temporarily place the sub-hopper 70K for black on the holder 155 as illustrated in FIG. 6B. Then, the operator removes the sub-hopper 70S for special color from the apparatus body 100A in a direction indicated by arrow A8 in FIG. 6B.

The operator installs the removed sub-hopper 70S for special color in the rightmost installation position in the apparatus body 100A as indicated by arrow A9 in FIG. 6C.

The operator removes the sub-hopper 70K for black from the holder 155 and installs the removed sub-hopper 70K for black in the leftmost installation position in the apparatus body 100A as indicated by arrow A10 in FIG. 6D.

Finally, the covers 151 close.

Processes of returning from the arrangement illustrated in FIG. 6D to the basic arrangement illustrated in FIG. 6A is performed in reverse manner to the above-described processes.

In the present embodiment, the one holder 155, on which the sub-hopper 70K for black is temporarily placed, is provided to facilitate the swap process described above. Alternatively, in addition to the holder 155 to temporarily place the sub-hopper 70K for black, another holder can be provided to temporarily place the sub-hopper 70S for special color. Alternatively, the sub-hopper 70S for special color can include a hook 70*a* and can be temporarily placed on the holder 155.

In the present embodiment, the holder 155 is used for temporary placement when the sub-hopper 70K for black and the sub-hopper 70S for special color are swapped. Alternatively, another holder can be provided for temporary placement when the process cartridge 6K for black and the process cartridge 6S for special color are swapped, or the holder 155 can be shared as the holder for the process cartridge 6K. Further, the sub-hopper 70K and the process cartridge 6K for black united as a single unit can be simultaneously removed from and installed in the apparatus body 100A, and the sub-hopper 70S and the process cartridge 6S for special color united as a single unit can be simultaneously removed from and installed in the apparatus body 100A.

In the present embodiment, the sub-hopper 70S for special color is the removable component, and the sub-hopper 70K for black is the replacement removable component. Alternatively, the sub-hopper 70K for black can be the removable component, and the sub-hopper 70S for special color can be the replacement removable component.

Figure 8A:
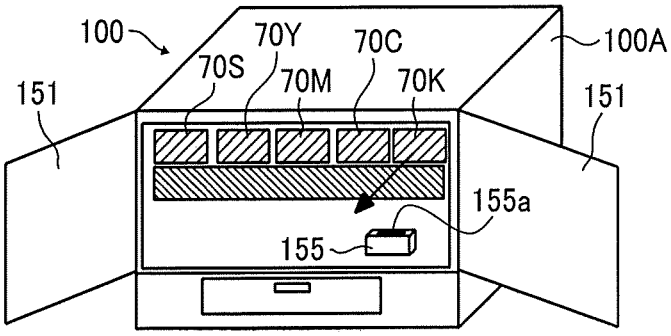
FIGS. 8A and 8B are schematic views illustrating a part of processes of swapping the sub-hoppers according to a first variation of the present disclosure.
Figure 8B:
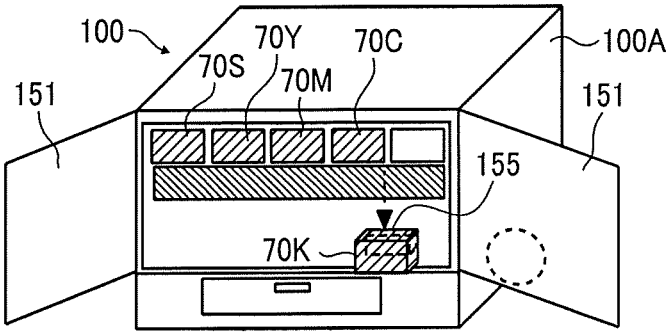

FIGS. 8A to 8B are schematic views illustrating a part of processes of swapping the sub-hoppers 70K and 70S in the apparatus body 100A according to a first variation of the present disclosure, corresponding to FIGS. 6A and 6B illustrating the above-described embodiment.

As illustrated in FIGS. 8A and 8B, in the image forming apparatus 100 according to the first variation of the present disclosure, the holder 155 to temporarily place the sub-hopper 70K for black (the replacement removable component) is disposed inside the apparatus body 100A of the image forming apparatus 100, not inside the cover 151.

When the cover 151 closes in a state in which the holder 155 holds the sub-hopper 70K for black, the sub-hopper 70K for black held by the holder 155 interferes with (contacts) a portion of the cover 151 enclosed by the dashed circle in FIG. 8B, thereby inhibiting the cover 151 from closing.

The holder 155 is far enough from the installation positions of the five sub-hoppers 70Y, 70M, 70C, 70K, and 70S. Therefore, the sub-hopper 70K held by the holder 155 does not inhibit the removal and installation of the sub-hopper 70K at the basic installation positions for the sub-hopper 70S for special color (the leftmost installation position) or for the sub-hopper 70K for black (the rightmost installation position).

With such a configuration according to the first variation, the efficiency to swap the sub-hopper 70S for special color and the sub-hopper 70K for black is improved, similarly to the above described embodiment.

Figure 9:
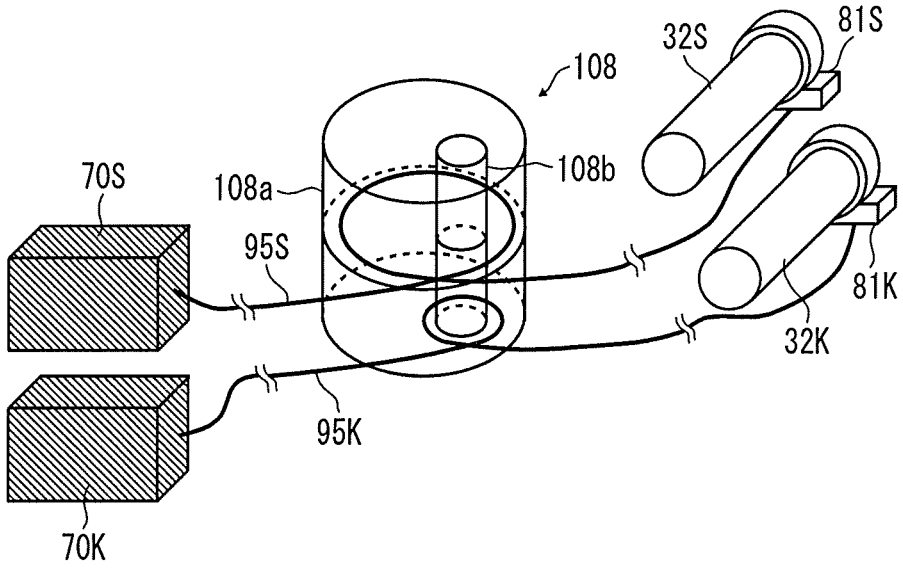
FIG. 9 is a schematic perspective view illustrating a part of an image forming apparatus according to a second variation of the present disclosure.

FIG. 9 is a schematic perspective view illustrating a partial configuration of an image forming apparatus 100 according to a second variation of the present disclosure. FIGS. 10A to 10D are schematic views illustrating processes of swapping the sub-hoppers 70K and 70S in the image forming apparatus 100, corresponding to FIGS. 6A and 6D in the above-described embodiment.

Figure 10A:
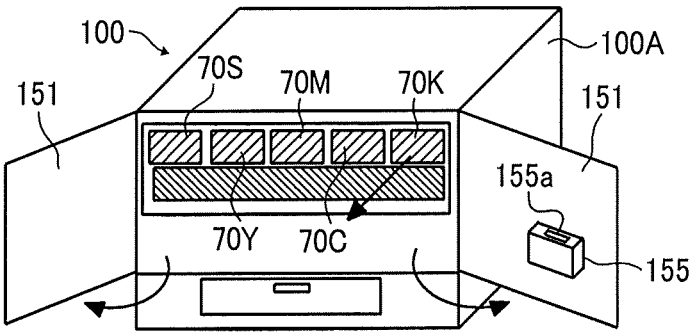
FIGS. 10A to 10D are schematic views illustrating processes of swapping the sub-hoppers in the image forming apparatus in FIG. 9.
Figure 10B:
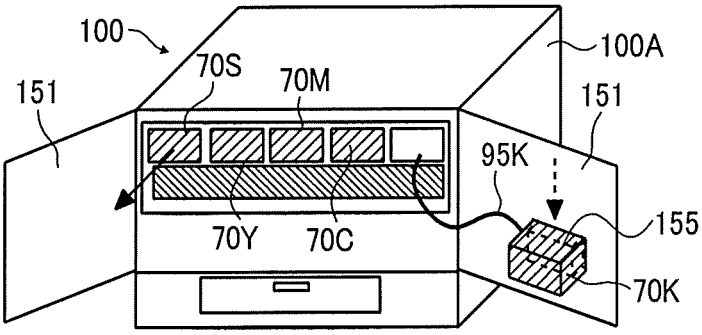
Figure 10C:
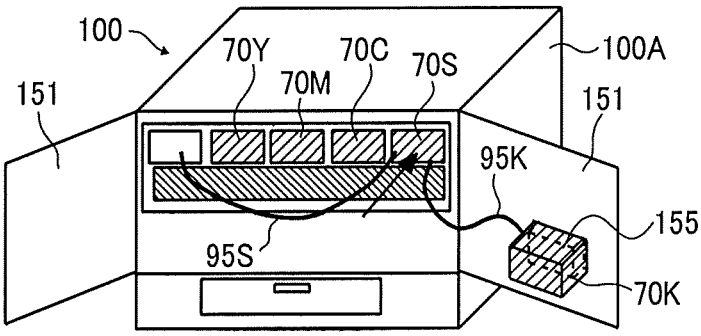
Figure 10D:
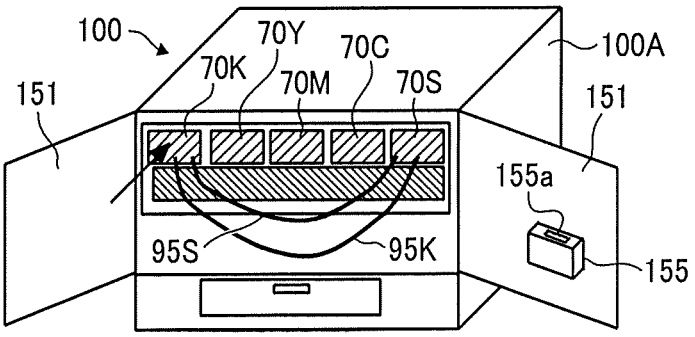

As illustrated in FIGS. 9 to 10D, in the image forming apparatus 100 according to the second embodiment, the sub-hopper 70S for special color (the removable component) and the sub-hopper 70K for black (the replacement removable component) containing different color toners (developers) can be swapped in a state in which the sub-hoppers 70S and 70K are coupled to the reservoirs 81S and 81K of the apparatus body 100A via tubes 95S and 95K, through which toner (developer) is transferred, respectively.

Accordingly, the toner container 32S and the reservoir 81S for special color and the toner container 32K and the reservoir 81K for black is not swapped. The sub-hopper 70S for special color and the sub-hopper 70K for black are rearranged (swapped) without being decoupled from the apparatus body 100A, in a state in which the sub-hoppers 70S and 70K are coupled to the reservoir 81S and 81K of the apparatus body 100A via the tubes 95S and 95K, respectively as illustrated in FIGS. 10A to 10D.

As illustrated in FIG. 9, the image forming apparatus 100 according to the second variation includes a tube housing 108 to accommodate a part of the tubes 95K and 95S. The tubes 95K and 95S are wound or folded without buckling in the tube housing 108.

Specifically, both the tube 95S for special color and the tube 95K for black are long enough to change the layouts thereof in conjunction with the swap of the sub-hoppers 70S and 70K. Therefore, after the sub-hoppers 70S and 70K are swapped, the length of the tubes 95K and 95S becomes excessive as illustrated in FIG. 10D.

As illustrated in FIG. 9, the tube housing 108 can reel in a portion of the tubes 95S and 95K without buckling and therefore can eliminate slackness of the tubes 95S and 95K and prevent entanglement of the tubes 95S and 95K without reducing ability to transport toner.

More specifically, as illustrated in FIG. 9, the tube housing 108 is a cylindrical member having a core shaft 108*b* therein, around which the tubes 95S and 95K wind once inside a cylindrical portion 108*a*. The tube housing 108 is shaped to allow the size of winding of the tubes 95S and 95K to change. That is, when the distances between both ends (an end portion coupled to the supply source and an end portion coupled to the supply destination) of the tubes 95S and 95K are short (normal time in which the sub-hoppers 70S and 70K are not swapped), the size of winding of the tubes 95S and 95K circling around the core shaft 108*b* is enlarged to be closer to the inner wall of the cylindrical portion 108*a*. On the other hand, when the distances between both ends of the tubes 95S and 95K are long (when the sub-hoppers 70S and 70K are swapped), the size of winding of the tubes 95S and 95K circling around the core shaft 108*b* is reduced so that the tubes 95S and 95K becomes closer to the core shaft 108*b*.

It is to be noted that the inner wall of the cylindrical portion 108*a* of the tube housing 108 has a curvature larger than the maximum curvature at which buckling occurs in the tubes 95S and 95K. The tube housings 108 are separated from each other to accommodate the tube 95S for special color and the tube 95K for black, respectively.

With such a configuration according to the second variation, the efficiency to swap the sub-hopper 70S for special color and the sub-hopper 70K for black is improved, similarly to the above-described embodiment.

Note that, when the length of the tube 95S for special color is shorter than the tube 95K for black so that the sub-hopper 70S for special color does not reach the holder 155, the operator does not accidentally place the sub-hopper 70S for special color on the holder 155. Therefore, the operator can smoothly swap the sub-hoppers 70S and 70K in the processes illustrated in FIGS. 10A to 10D.

FIGS. 11A to 11D are schematic views illustrating processes of replacing a present fixing device 20A with a new fixing device 20B according to a third variation of the present disclosure, corresponding to FIGS. 6A and 6D in the above-described embodiment.

According to the third variation, for simply replacing the present fixing device 20A (a removable component), the new fixing device 20B (a replacement removable component) is installed in a position, in which the present fixing device 20A (the removable component) is installed, instead of the present fixing device 20A (the removable component). These replacement processes are different from the swap processes in the above-described embodiments. In the swap processes, for rearranging the sub-hopper 70S for special color (the removable component), the sub-hopper 70K for black (the replacement removable component) is installed in the position, in which the sub-hopper 70S for special color (the removable component) is installed, instead of the sub-hopper 70S for special color (the removable component). Accordingly, in the third variation, the present fixing device 20A (the removable component) has the same configuration and function as the new fixing device 20B (a replacement removable component). Note that, these replacement process is performed when the present fixing device 20A (the removable component) reaches the end of life.

Next, a description is provided of a series of processes for replacement of the fixing device 20A by the operator according to the third variation, with reference to FIGS. 11A to 11D.

Figure 11A:
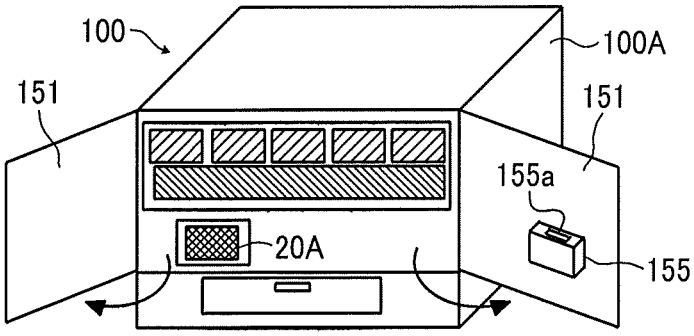
FIGS. 11A to 11D are schematic views illustrating processes of replacing a fixing device according to a third variation of the present disclosure.

As illustrated in FIG. 11A, the covers 151 open from the closed state in FIG. 5, and the present fixing device 20A and the holder 155 are revealed.

Figure 11B:
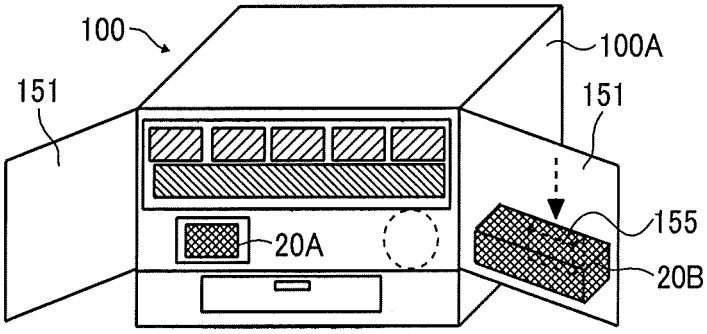

The operator temporarily places the new fixing device 20B for replacement on the holder 155 as indicated by dashed arrow in FIG. 11B. At that time, the new fixing device 20B held by the holder 155 interferes with (contacts) a portion of the apparatus body 100A enclosed by dashed circles illustrated in FIGS. 11B and 11C and inhibits the cover 151 from closing. Further, the new fixing device 20B held by the holder 155 does not inhibit the operator from removing and installing the present fixing device 20A from and in the image forming apparatus 100.

Figure 11C:
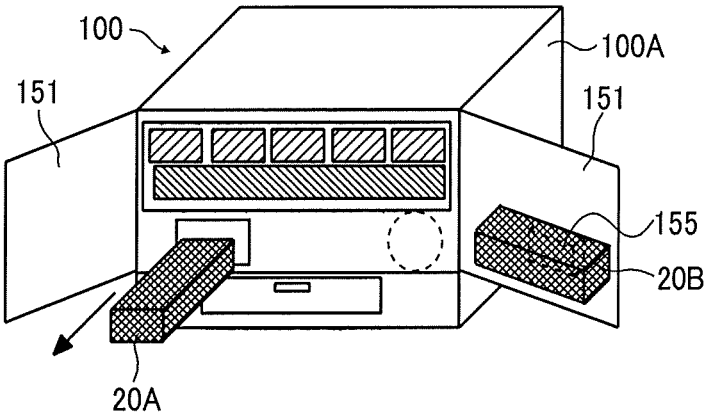

The operator removes the present fixing device 20A from the apparatus body 100A in a direction indicated by arrow in FIG. 11C.

Figure 11D:
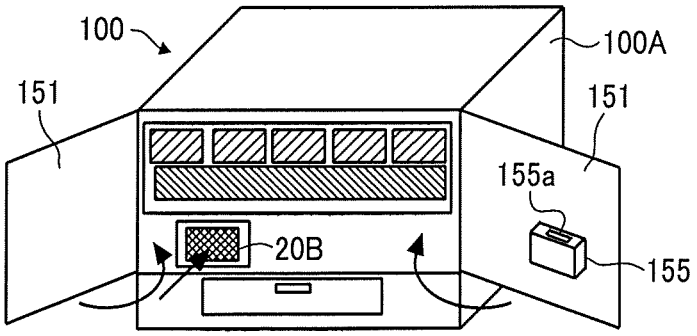

Then, the operator takes the new fixing device 20B for replacement from the holder 155 and installs the new fixing device 20B in the apparatus body 100A as illustrated in FIG. 11D.

Finally, the covers 151 close.

With such a configuration in the third variation, problems are prevented that it takes time and effort for the operator to secure space and that the operator forgets to install the new fixing device 20B for replacement after removing the present fixing device 20A from the apparatus body 100A. Therefore, an efficiency for replacing the fixing device 20 is improved.

Note that, in the third variation, examples of the removable component and the replacement removable component are the fixing devices 20A and 20B. Alternatively, the present disclosure can be adopted to any unit or component other than the fixing device 20, similarly to the third variation.

As described above, the holder 155 is configured to hold the sub-hopper 70K for black (the replacement removable component) at a position other than the normal installation position of the sub-hopper 70S for special color (the removable component) in a state in which the covers 151 open and the sub-hopper 70S for special color (the removable component) is installed in the apparatus body 100A. The sub-hopper 70K for black is installable in and removable from the normal installation position of the sub-hopper 70S for special color. The sub-hopper 70K for black as the replacement removable component held by the holder 155 inhibits the cover 151 from closing.

Therefore, it does not take time and effort for the operator to secure space for temporary placement of the sub-hopper 70K for black. Further, the operator does not forget to install the sub-hopper 70K for black after removing the sub-hopper 70S for special color from the apparatus body 100A.

In the embodiments described above, the photoconductor drum 1Y serving as the image bearer, the charger 4Y, the developing device 5Y, and the cleaner 2Y are united as the process cartridge 6Y. However, the present disclosure is not limited to the embodiments described above and applied to the image forming apparatus 100 in which the developing device 5Y and the photoconductor drum 1Y are removably installed as a single unit, respectively.

It is to be noted that the term "process cartridge" used in the present specification means a unit including an image bearer and at least one of a charger to charge the image bearer, a developing device to develop latent images on the image bearer, and a cleaner to clean the image bearer united together and is designed to be removably installed together in the apparatus body of the image forming apparatus.

In the above-described embodiments, the present disclosure is adopted to the image forming apparatus 100 in which the developer supply devices 90Y, 90M, 90C, 90K, and 90S include the cap holder 91, the reservoir 81, the conveyance pump 60, the sub-hopper 70, the tube 95, and the conveyance pipe 98, but the configuration of the developer supply device 90 is not limited thereto.

In the above-described embodiments, the present disclosure is adopted to the image forming apparatus 100 in which the toner containers 32Y, 32M, 32C, 32K, and 32S are substantially cylindrical, and the bodies of the toner containers 32Y, 32M, 32C, 32K, and 32S are rotatably driven, but the configuration of the toner container is not limited thereto.

In the above-described embodiments, the present disclosure is adopted to the image forming apparatus 100 in which the plurality of photoconductor drums 1Y, 1M, 1C, 1K, and 18 (the image bearers) are arranged side by side along the rotation direction of the intermediate transfer belt 8 (the intermediate transferor) that moves in the predetermined rotation direction. Meanwhile, the present disclosure can also be applied to an image forming apparatus employing a transfer conveyance belt, in which the plurality of image bearers is arranged side by side along the direction of movement of the sheet that moves with the transfer conveyance belt in the predetermined rotation direction.

In such configurations, effects similar to those described above are also attained.

The above-described embodiments are illustrative and do not limit the present disclosure. Thus, numerous additional modifications and variations are possible in light of the above teachings. It is therefore to be understood that within the scope of the present disclosure, the present disclosure may be practiced otherwise than as specifically described herein. The number, position, and shape of the components of the image forming apparatus described above are not limited to those described above.

What is claimed is:

1. An image forming apparatus comprising:

an apparatus body;

a removable component configured to be removably installed in an installation position in the apparatus body;

a cover configured to open and close when the removable component is installed in or removed from the installation position;

a replacement removable component configured to be installable in and removable from the installation position in which the removable component is installed; and a holder configured to hold the replacement removable component at a different position from the installation position when the removable component is installed in the installation position and the cover opens, the replacement removable component held by the holder configured to inhibit the cover from closing.

2. The image forming apparatus according to claim 1, wherein the removable component is installable in and removable from the apparatus body when the holder holds the replacement removable component.

3. The image forming apparatus according to claim 1, wherein the holder is attached to the cover.

4. The image forming apparatus according to claim 1, wherein the holder is disposed inside the apparatus body.

5. The image forming apparatus according to claim 1, wherein the replacement removable component is installed in another installation position different from the installation position of the removable component and a position of the holder, and wherein the removable component and the replacement removable component are swappable with each other.

6. The image forming apparatus according to claim 5, wherein the removable component and the replacement removable component employ developers of different colors from each other.

7. The image forming apparatus according to claim 6, further comprising tubes configured to convey the developers, wherein the removable component and the replacement removable component are swappable with each other in a state in which the removable component and the replacement removable component are coupled to the apparatus body via the tubes, respectively.

8. The image forming apparatus according to claim 1, wherein the replacement removable component includes a hook, and the holder has an engagement portion engageable with the hook.

9. The image forming apparatus according to claim 1, wherein the replacement removable component held by the holder interferes with the apparatus body or the cover and inhibits the cover from closing, and wherein the replacement removable component held by the holder does not interfere with the removable component and does not inhibit the removable component from being installed in and removed from the apparatus body.

* * * * *